United States Patent [19]

Okamura et al.

[11] 4,339,518

[45] Jul. 13, 1982

[54] PROCESS OF ELECTROSTATIC PRINTING WITH FLUORINATED POLYMER TONER ADDITIVE

[75] Inventors: Kazuo Okamura, Itami; Shigeo Daimon, Osaka; Nobuyuki Tomihashi, Takatsuki, all of Japan

[73] Assignee: Daikin Kogyo Co., Ltd., Osaka, Japan

[21] Appl. No.: 195,076

[22] Filed: Oct. 8, 1980

[30] Foreign Application Priority Data

Oct. 18, 1979 [JP] Japan ..... 54-135657
Oct. 23, 1979 [JP] Japan ..... 54-137422

[51] Int. Cl.[3] ..... G03G 13/16; G03G 13/22

[52] U.S. Cl. ..... 430/126; 430/109; 430/110; 430/114; 430/115

[58] Field of Search ..... 430/109, 110, 114, 115, 430/126; 101/DIG. 13

[56] References Cited

U.S. PATENT DOCUMENTS

| | | | |
|---|---|---|---|
| 3,574,614 | 4/1971 | Carreira | 430/126 X |
| 3,576,624 | 4/1971 | Matkan | 430/126 X |
| 4,139,483 | 2/1979 | Williams et al. | 430/110 |
| 4,187,329 | 2/1980 | Crooks | 430/110 |

FOREIGN PATENT DOCUMENTS

| | | | |
|---|---|---|---|
| 54-5435 | 1/1979 | Japan | 430/109 |

*Primary Examiner*—Roland E. Martin, Jr.
*Attorney, Agent, or Firm*—Armstrong, Nikaido, Marmelstein & Kubovcik

[57] ABSTRACT

A process of electrostatic printing which comprises the steps of forming a reverse image of a dielectric toner on an electroconductive support or a photoconductive support, fixing the reverse image to give an electrostatic printing master sheet, and conducting electrostatic printing in which electrification of the dielectric toner image on the master sheet, development with a toner, transfer of the resulting toner image to a material to be printed and fixing are repeatedly carried out to give numerous sheets of duplicates.

1 Claim, 6 Drawing Figures

PROCESS OF ELECTROSTATIC PRINTING WITH FLUORINATED POLYMER TONER ADDITIVE

BACKGROUND OF THE INVENTION

The present invention relates to a novel process of electrostatic printing, and more particularly to an electrostatic printing process in which an electrostatic printing master sheet or plate having reverse images of a dielectric toner is prepared and a large number of duplicates are produced using the master sheet or plate by repeating electrostatic printing procedures of electrification of the dielectric toner images, development of the images with a toner, transfer of the toner images to a material to be printed and fixing of the transferred images thereon.

In recent years, electrophotography shows marked progress, and many processes have been proposed or put to practical use. There are widely employed a direct process called generally electrofax process in which a photoconductive support is directly electrified, exposed imagewise to light and developed with a toner and the toner image is then fixed; and an indirect process called xerography or plain paper copying process in which a photoconductive, photosensitive body is electrified, exposed imagewise to light and developed with a toner and the toner image so formed once on the photoconductive, photosensitive body is then transferred to a material to be printed and is fixed thereon. There is also known an electrostatography in which an electric signal is directly applied to an electrostatographic paper consisting of an electroconduction-treated support and a dielectric layer to form an electrostatic latent image and then a toner image is formed by development of the latent image with a toner and is fixed.

These electrophotographic processes are suited for production of a relatively small number of duplicates, but not for production of a large number of duplicates at a high speed from the original.

An electrophotographic copying machine called high speed plain paper copying machine capable of reproducing at a speed of 40 to 70 sheets per minute has been lately developed, but there are problems to be solved in reliability and machine cost.

Accordingly, it is a main object of the present invention to provide a process for electrostatic printing suited for making a multitude of duplicates at high speeds.

Another object of the present invention is to provide a process for electrostatic printing which can inexpensively produce a multitude of duplicates with simple procedures.

These and other objects of the invention will become apparent from the description hereinafter.

SUMMARY OF THE INVENTION

In accordance with the present invention, there is provided a process of electrostatic printing which comprises the steps of (1) forming a reverse image of a dielectric toner on an electroconductive support or a photoconductive support and fixing the reverse image to give an electrostatic printing master sheet, and (2) repeating electrostatic printing procedures of (a) electrifying the dielectric toner image of the master sheet, (b) developing it with a toner, (c) transferring the resulting toner image to a material to be printed and (d) fixing the transferred toner image thereon, said dielectric toner having a volume intrinsic resistivity of not less than $10^{12}$ Ωcm. and showing a critical surface tension of not more than 30 dynes/cm. after fixing.

In the electrostatic printing process of the present invention, an electrostatic printing master sheet or plate on which a reverse image of a dielectric toner is fixed is first prepared and a multitude of duplicates are produced using the master sheet by repeatedly conducting electrification of the dielectric toner image, development with a toner, transfer of the toner image and fixing, and accordingly exposure to light to obtain an electrostatic latent image corresponding to the original is required only in the preparation of the master sheet and is not required in the electrostatic printing step for producing duplicates. Thus, the process of the present invention need not the exposure to light to obtain an electrostatic latent image as conducted for every production of a sheet of duplicate in conventional xerography and electrofax processes, and moreover, procedures such as removal of electrostatic charge and cleaning of the photosensitive body as required in xerography can be omitted. For these reasons, the process of the present invention is very suited for producing more than 500 sheets of duplicates at a high speed. Also, an apparatus for practicing the process of the invention can be simplified, and numerous sheets of duplicates can be obtained inexpensively.

DETAILED DESCRIPTION

The process of the present invention will be explained with reference to the accompanying drawings.

Figure 1:
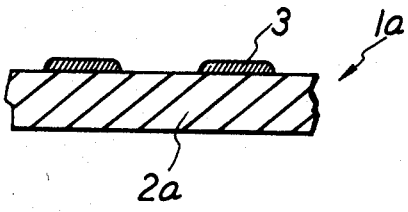
FIGS. 1 and 2 are diagrammatic section views showing embodiments of electrostatic printing master sheets employed in the process of the present invention.
Figure 2:
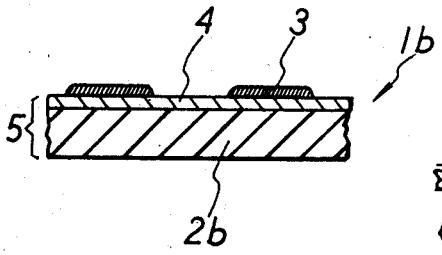

In the process of the present invention, an electrostatic printing master sheet or plate is first prepared by a known electrophotography. FIGS. 1 and 2 are diagrammatic section views showing embodiments of electrostatic printing master sheets. An electrostatic printing master sheet 1*a* shown in FIG. 1 is prepared by forming a reverse image 3 of a dielectric toner on an electroconductive support 2*a* and fixing it thereon, for instance, by means of xerography. An electrostatic printing master sheet 1*b* shown in FIG. 2 is prepared by forming a reverse image 3 of a dielectric toner on a photoconductive layer 4 of a photoconductive support 5 consisting of an electroconductive support 2*b* and the photoconductive layer 4 provided thereon, and fixing the reverse image, for instance, by means of electrofax process.

Figure 3:
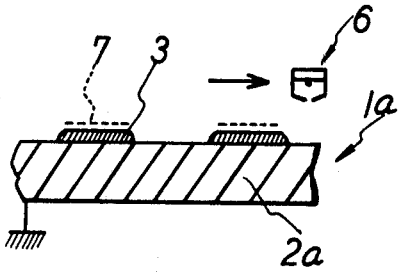
FIGS. 3 to 6 are diagrammatic section views showing an embodiment of an electrostatic printing step in the process of the present invention.
Figure 4:
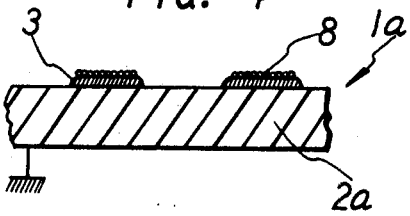
Figure 5:
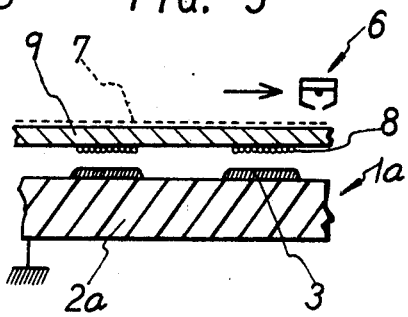
Figure 6:
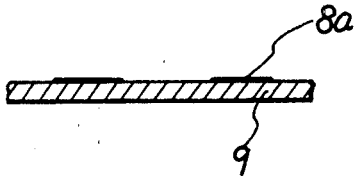

The thus prepared electrostatic printing master sheet is employed in producing numerous sheets of duplicates. FIGS. 3 to 6 are diagrammatic section views showing an embodiment of the steps of conducting electrostatic printing in order. As shown in FIG. 3, the dielectric toner image 3 on the master sheet 1*a* is first electrified by a corona discharge apparatus 6. Reference numeral 7 shows electrostatic charge. A usual toner as used in a conventional electrophotography is then stuck to the electrified dielectric toner image 3 to form a toner image 8 as shown in FIG. 4. As shown in FIG. 5, a material 9 to be printed such as a plain paper is superposed on the toner image 8 and is electrified by the corona discharge apparatus 6 from the back of the material 9, thus transferring the toner image 8 to the material 9. The transferred toner image 8 on the material 9 is fixed to give a duplicate having an image 8*a* corresponding to the original, as shown in FIG. 6.

In case of conducting the electrostatic printing by using the electrostatic printing master sheet 1*b*, the dielectric toner image 3 is electrified by corona discharge of the master sheet 1*b* followed by exposure of the whole surface of the master sheet 1*b* to light, by which the electrostatic charge of the photoconductive layer portion charged together with the dielectric toner image 3 is quenched. The procedures other than the electrification are the same as the electrostatic printing using the master sheet 1*a*. Although the exposure of the whole surface to light is necessary in the electrostatic printing step when the master sheet 1*b* is used, this can be done by exposing the whole surface of the master sheet 1*b* to light at a time, unlike the imagewise exposure to light for forming an electrostatic latent image corresponding to the original, which is conducted for every production of a sheet of duplicate, as in the xerography and electrofax. Therefore, the exposure can be made in a very short time, and does not impair the effect of the invention, i.e. high speed reproduction.

Examples of the electroconductive support 2*a* used in the preparation of the electrostatic printing master sheet 1*a* are metal sheets, foils or leafs such as aluminum, iron and nickel, multilayer films or papers such as metal evaporation films or papers of the above metals and laminates of films or papers with the above metal foils or leafs, and coated papers with electroconductive resins such as polyvinylbenzyltrimethylammonium chloride, sodium polyacrylate, sodium polymethylenesulfonate, poly(N,N-dimethyl-3,5-methylenepiperidinium chloride) and poly(2-methacryloyloxyethyltrimethylammonium chloride). Also, as the electroconductive support 2*b* of the photoconductive support 5 used in the preparation of the electrostatic printing master sheet 1*b*, the same materials as the above-mentioned electroconductive materials 2*a* are used, and on such an electroconductive support 2*b* there is provided to give the photoconductive support 5 a photoconductive layer 4 as used in a conventional electrofax. The photoconductive layer 4 includes a powder of a photoconductive material such as zinc oxide, cadmium sulfide, cadmium selenide, cadmium telluride or copper phthalocyanine and a resin as a binder such as styrene homopolymer and copolymers, acrylic resins, silicone resins or vinyl acetate resins.

In the process of the present invention, a reverse image 3 of the electrostatic printing master sheet 1*a* or 1*b* is formed in the same manner as a known electrophotography. Therefore, the toner used in the preparation of the master sheet is required to have properties as required for those used in a known electrophotography, e.g. good stability in frictional electrification, flowability, anti-agglomeration and fixing stability. Moreover, for obtaining numerous sheets of duplicates having a sharp image from the master sheet to which an image of such a toner is fixed, it is necessary that the toner further has properties as required for a carrier coating agent used in a known electrophotography, e.g. good charging property, frictional resistance and property of preventing sedimentation of a toner.

Accordingly, a dielectric toner having a large frictional charging property and a low surface energy is preferably employed as a toner for forming the reverse image 3. In particular, there is more preferred a dielectric toner such that a volume intrinsic resistivity of the toner is not less than $10^{12}$ Ωcm. and a critical surface tension after fixing of the toner is not more than 30 dynes/cm. When the volume intrinsic resistivity is less than $10^{12}$ Ωcm., the frictional charging property becomes small, and when the critical surface tension is more than 30 dynes/cm., the property of preventing sedimentation of a toner used in the next electrostatic printing step becomes small, and as a result, numerous sheets of duplicates are hard to obtain. Suitable materials for such a dielectric toner are a thermoplastic silicone resin and fluorine-containing resin having a low surface energy. The dielectric toner made of these materials may be employed alone or in admixture with other resins.

It has been found that when a dielectric toner for forming the reverse image 3 contains a particular fluorine-containing resin in an amount of at least 0.5% by weight calculated as fluorine, it gives the electrostatic printing master sheet 1*a* or 1*b* durable the production of a large number of duplicates and very suited for use in the process of the present invention. Since the fluorine-containing resin has an excellent frictional charging property, a low surface energy and an excellent lubricating property, such a dielectric toner containing the fluorine-containing resin has good stability in frictional electrification, flowability, anti-agglomeration, fixing stability, frictional resistance and property of preventing sedimentation of a toner. Accordingly, when such a dielectric toner is employed in the preparation of the electrostatic printing master sheet, the obtained master sheet is very suited for use in producing numerous sheets of duplicates.

A fluorine-containing resin having a melting point or softening point of not less than 40° C., especially not less than 60° C. and a melt viscosity of less than about $5\times10^4$ poises at a temperature of not more than 220° C., especially not more than 180° C. is suitable as the fluorine-containing resin according to the present invention. Typical examples of the fluorine-containing resins are polymers having a perfluoroalkyl group and polymers containing a fluoroolefin as structural units, e.g. homopolymers or copolymers with nonfluorinated monomers, especially those having a molecular weight of 10,000 to 500,000, of a fluorinated monomer having the following general formula (I):

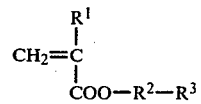

(I)

wherein $R^1$ is hydrogen, methyl group, ethyl group or propyl group, $R^2$ is the group $$-(CH_2)_l-$$

where l is an integer of 1 to 3, the group

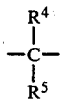

where $R^4$ and $R^5$ are independently hydrogen, methyl group, ethyl group or propyl group, provided that $R^4$ and $R^5$ are not simultaneously hydrogen, the group $$-CH_2\underset{\underset{R^6}{|}}{C}HCH_2-$$

where $R^6$ is hydroxyl group or acetoxyl group, or the group $$-SO_2\underset{\underset{R^7}{|}}{N}CH_2CH_2-$$

where $R^7$ is methyl group, ethyl group or propyl group, and $R^3$ is the group $$-(CF_2)_mCF_3$$

where m is 0 or an integer of 1 to 18, the group $$-(CF_2)_nCF\begin{matrix}\diagup CF_3\\ \diagdown CF_3\end{matrix}$$

where n is 0 or an integer of 1 to 18, the group $$-(CF_2)_qH$$

where q is an integer of 2 to 6, or the group $-CF_2CFHCF_3$; and polymers of one or more fluorinated monomers or copolymers of one or more fluorinated monomers with nonfluorinated monomers, having the following general formula (II):

$$\begin{matrix} R^8 & & R^{10} \\ | & & | \\ C & = & C \\ | & & | \\ R^9 & & R^{11} \end{matrix} \qquad \text{(II)}$$

wherein $R^8$, $R^9$ and $R^{10}$ are independently hydrogen or fluorine, and $R^{11}$ is fluorine, chlorine, $-CF_3$ or $-O(CF_2)_rCF_3$ where r is an integer of 2 to 5, provided that $R^8$, $R^9$ and $R^{10}$ are not simultaneously hydrogen when $R^{11}$ is chlorine. These fluorine-containing resins may be employed alone or in admixture thereof.

Examples of the nonfluorinated monomer to be copolymerized with the above-mentioned fluorinated monomer are (1) acrylic acid, methacrylic acid and their esters such as methyl, ethyl, butyl, isobutyl, propyl, 2-ethylhexyl, hexyl, decyl, $\beta$-hydroxyethyl and glycidyl esters, (2) vinyl esters with fatty acids such as acetic acid, propionic acid, caprylic acid, lauric acid and stearic acid, (3) styrene compounds such as styrene, $\alpha$-methylstyrene and p-methylstyrene, (4) halogenated vinyl or vinylidene compounds such as vinyl chloride, vinyl bromide and vinylidene chloride, (5) allyl esters of fatty acids such as allyl heptanoate, allyl caprilate and allyl caproate, (6) vinyl alkyl ketones such as vinyl methyl ketone and vinyl ethyl ketone, (7) acrylic amides such as N-methylacrylic amide and N-methylolmethacrylic amide, (8) dienes such as 2,3-dichloro-1,3-butadiene and isoprene, (9) ethylenically unsaturated compounds such as ethylene, propylene and isobutylene, and (10) maleic anhydride and phthalic anhydride. It is desirable that the copolymer of the fluorinated monomer and the nonfluorinated monomer contains at least 40% by weight of the fluorinated monomer units.

The homopolymers and copolymers of the fluorinated monomer (I) is preferred as a fluorine-containing resin from viewpoints of surface characteristics of the toner such as low surface energy and lubricating property and processability.

The fluorine-containing resins may be employed alone or in admixture with known toners for electrophotography. From viewpoints of economy and easiness in molding, the fluorine-containing resins are usually employed as a dielectric toner in the form of mixture with one or more resins used as a toner in conventional electrophotography such as polystyrene, polymethylstyrene, styrene copolymers, rosin modified phenol resins, oil modified epoxy resins, polyurethane, cellulose resins, polyethers and butyl polymethacrylate. It is necessary that the content of the fluorine-containing resin is at least 0.5% by weight, preferably at least 1% by weight, calculated as fluorine. When the fluorine content in the dielectric toner is less than 0.5% by weight, the characteristics of the fluorine-containing resin such as a high frictional charging property, low surface energy and excellent lubricating property cannot be sufficiently exhibited, and it becomes difficult to obtain numerous sheets of duplicates having a sharp image. Although the upper limit of the fluorine content is not particularly limited, the fluorine content of not more than 70% by weight is usually preferred.

The dielectric toner made of the fluorine-containing resin is prepared in the same manner as the preparation of a conventional toner for electrophotography, for instance, by kneading the fluorine-containing resin or a mixture of the fluorine-containing resin and a conventional toner resin, and pulverizing it. The particle size of the toner is usually from 2 to 30$\mu$. If necessary, upon kneading there may be added an additive such as a coloring agent, i.e. pigment or dyestuff for toner, e.g. carbon black or Nigrosine dye, or various controlling agents, e.g. an agent for controlling charge and a fog preventing agent.

The dielectric toner may be employed in the preparation of the electrostatic printing master sheet in the form of a dry developer in which the toner is used alone or is admixed with a solid carrier, or a wet developer in which the toner is dispersed in a liquid carrier.

A reverse image 3 of the dielectric toner may be formed on an electroconductive support 2*a* to give an electrostatic printing master sheet 1*a* by conducting electrification, imagewise exposure to light, development, transfer and fixing in the same manner as the xerography, or may be formed on a photoconductive support 5 to give an electrostatic printing master sheet 1*b* by conducting electrification, imagewise exposure to light, development and fixing in the same manner as the electrofax.

By employing the thus obtained electrostatic printing master sheet 1*a* or 1*b*, reproduction is conducted in the next electrostatic printing step in which each procedure of the electrification of the dielectric toner image, development, transfer and fixing is conducted according to a conventional electrophotography. Usual toners as used in a conventional electrophotography are employed in the electrostatic printing step, e.g. a mixture of a resin such as polystyrene, polymethylstyrene, styrene copolymers, rosin modified phenol resins, oil modified epoxy resins or acrylic resins with a coloring agent such as carbon black or Nigrosine dye. Such toners may be employed as a dry developer or a wet developer.

The process of the present invention is more particularly described and explained by means of the following Examples, in which all % and parts are by weight unless otherwise noted.

EXAMPLE 1

A vibrating mill was charged with 20 parts of a homopolymer (melting point: 80° C., melt viscosity: $1\times10^2$ poises at 100° C.) of a monomer shown by the following formula:

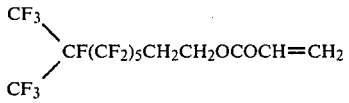

and 100 parts of a styrene resin (commercial name "PICCOLASTIC D125" made by Esso Standard Petroleum Kabushiki Kaisha) to pulverize them. The mixture was then kneaded sufficiently by a heat roll and cooled to solidify. The solidified material was then roughly pulverized by a hammer mill and finely pulverized by a jet mill to give a toner particle having an average particle size of about 10μ. The content of the fluorine-containing resin in the toner particle was 10.6% calculated as fluorine. The volume intrinsic resistivity of the toner particle was about $10^{17}$ Ωcm., and the critical surface tension of the toner particle after fixing was about 15 dynes/cm.

A developer was prepared by mixing 3 parts of the obtained toner particle and 100 parts of a steel carrier having an average particle size of 100μ.

By employing the thus prepared developer, an electrostatic printing master sheet was prepared by forming a reverse image on an aluminum foil of 100μ in thickness surface-treated with an inorganic acid and thermally fixing the image at 160° C. according to the xerography.

The electrostatic printing master sheet was subjected to corona discharge to electrify the image portion, and the image was developed with a usual developer for xerography consisting of 3 parts of a toner particle having an average particle size of about 15μ, which was made from a mixture of 100 parts of a styrene resin (commercial name "PICCOLASTIC D125" made by Esso Standard Petroleum Kabushiki Kaisha), 5 parts of a coloring agent (commercial name "PEERLESS 155" made by Columbia Ribbon & Carbon Mfg. Co., Inc.) and 5 parts of carbon black (commercial name "Oil Black BW" made by Orient Kagaku Kogyo Kabushiki Kaisha), and 100 parts of a steel carrier having an average particle size of about 100μ. The developed image was then transferred to a paper to be printed and fixed. These electrostatic printing procedures were repeated to give more than 500 sheets of duplicates having a sharp image and no fog.

EXAMPLE 2

A liquid developer was prepared by admixing 10 parts of the toner particle obtained in Example 1, 0.1 part of aluminum stearate and 100 parts of an isoparaffin solvent (commercial name "Isoper H" made by Esso Standard Petroleum Kabushiki Kaisha) in a ball mill for 48 hours and dispersing 5 parts of the resulting dispersion into 1,000 parts of Isoper H.

By employing the obtained liquid developer, an electrostatic printing master sheet was prepared by forming a reverse image on an electroconductive paper which was a coated paper of 55 g./m.$^2$ in basis weight treated with polyvinylbenzyltrimethylammonium chloride (commercial name "ECR 77" made by Dow Chemical Co.), drying and thermally fixing the image at 150° C. by means of a xerography type wet copying machine.

The electrostatic printing was repeatedly conducted by employing the thus obtained master sheet in the same manner as in Example 1. More than 500 sheets of duplicates having a sharp image and no fog were obtained.

EXAMPLE 3

A toner particle and a developer were prepared in the same manner as in Example 1 except that a vinylidene fluoride/tetrafluoroethylene copolymer (4:1 by mole) having a melting point of 130° C. and a melt viscosity of $10^4$ poises at 150° C. was employed as a fluorine-containing resin. The content of the fluorine-containing resin in the toner particle was 10.7% calculated as fluorine. The volume intrinsic resistivity of the toner particle was about $10^{16}$ Ωcm., and the critical surface tension of the toner particle after fixing was about 24 dynes/cm.

An electrostatic printing master sheet was prepared by employing the thus prepared developer in the same manner as in Example 1 except that the fixing was conducted at 180° C., and the electrostatic printing was then carried out in the same manner as in Example 1 to give 500 sheets of duplicates having a sharp image and no fog.

EXAMPLE 4

A toner particle and a developer were prepared in the same manner as in Example 1 except that the fluorine-containing resin was employed in an amount of 2 parts. The content of the fluorine-containing resin in the toner particle was 1.2% calculated as fluorine. The volume intrinsic resistivity of the toner particle was about $10^{17}$ Ωcm., and the critical surface tension of the toner particle after fixing was about 21 dynes/cm.

The preparation of the master sheet and the electrostatic printing were conducted in the same manner as in Example 1 except that the above developer was employed in preparing the master sheet, to give 500 sheets of duplicates having a sharp image and no fog.

EXAMPLE 5

A toner particle was prepared in the same manner as in Example 1 except that a homopolymer (softening point: 65° C., melt viscosity: $5\times10^2$ poises at 100° C.) of a monomer having the following formula:

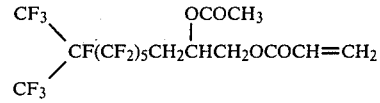

was employed as a fluorine-containing resin. The content of the fluorine-containing resin in the toner particle was 7.7% calculated as fluorine. The volume intrinsic resistivity was about $10^{17}$ Ωcm., and the critical surface tension of the toner particle after fixing was about 17 dynes/cm. By employing the obtained toner particle, a liquid developer was prepared in the same manner as in Example 2.

A electrostatic printing master sheet was prepared by employing the above liquid developer in the same manner as in Example 2, and the electrostatic printing was carried out in the same manner as in Example 1 to give more than 500 sheets of duplicates having a sharp image and no fog.

EXAMPLE 6

A toner particle and a developer were prepared in the same manner as in Example 1 except that a copolymer (melting point: 85° C., melt viscosity: $3\times10^3$ poises at 100° C.) of 85% of a monomer having the following formula:

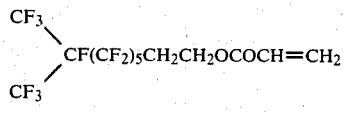

7.5% of 2-ethylhexyl methacrylate and 7.5% of glycidyl methacrylate was employed as a fluorine-containing resin. The fluorine-containing resin content in the toner particle was 9% calculated as fluorine. The volume intrinsic resistivity of the toner particle was about $10^{16}$ Ωcm., and the critical surface tension of the toner particle after fixing was about 19 dynes/cm.

The preparation of the master sheet and the electrostatic printing were carried out in the same manner as in Example 1 to obtain more than 500 sheets of duplicates having a sharp image and no fog.

EXAMPLE 7

A toner particle was prepared in the same manner as in Example 1 except that 10 parts of a coloring agent (commercial name "PEERLESS 155" made by Columbia Ribbon & Carbon Mfg., Co., Inc.) was further employed in addition to the fluorine-containing resin and the styrene resin. The content of the fluorine-containing resin in the toner particle was 9.8% calculated as fluorine. The volume intrinsic resistivity of the toner particle was about $10^{16}$ Ωcm., and the critical surface tension of the toner particle after fixing was about 16 dynes/cm.

A liquid developer was prepared by admixing 10 parts of the toner particle, 0.1 part of cobalt naphthenate and 100 parts of Isoper H, and dispersing 5 parts of the resulting dispersion into 1,000 parts of Isoper H.

A photoconductive sheet was prepared by coating a photoconductive composition in which zinc oxide was dispersed in an isobutyl methacrylate/n-butylmethacrylate copolymer (1:1 by mole) onto the electroconductive paper used in Example 2. By employing the liquid developer, an electrostatic printing master sheet was prepared by forming a reverse image on the photoconductive sheet, drying and thermally fixing the image at 150° C. according to the electrofax process.

The master sheet was subjected to corona discharge and its whole surface was exposed to light to electrify only the image portion. By employing the same xerography developer as that used for electrostatic printing in Example 1, the development, transfer and fixing were conducted. These electrostatic printing procedures were repeated to give more than 500 sheets of duplicates having a sharp image and no fog.

EXAMPLE 8

A toner particle and a liquid developer were prepared in the same manner as in Example 7 except that the fluorine-containing resin was replaced with that used in Example 3. The fluorine-containing resin content in the toner particle was 9.8% calculated as fluorine. The volume intrinsic resistivity of the toner particle was about $10^{15}$ Ωcm., and the critical surface tension of the toner particle after fixing was 26 dynes/cm.

An electrostatic printing master sheet was prepared by employing the above liquid developer in the same manner as in Example 7 except that the fixing was conducted at 180° C., and the electrostatic printing was carried out in the same manner as in Example 7 to give 400 sheets of duplicates having a sharp image and no fog.

EXAMPLE 9

The procedures of Example 7 were repeated except that a homopolymer (softening point: 70° C., melt viscosity: $5\times10^3$ poises at 150° C.) of a monomer shown by the following formula:

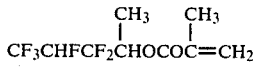

was employed as a fluorine-containing resin in the preparation of the toner particle and the fixing was conducted at 170° C. in the preparation of the electrostatic printing master sheet, to give 400 sheets of duplicates having a sharp image and no fog. The toner particle contained 7.2% of the fluorine-containing resin calculated as fluorine, and had a volume intrinsic resistivity of about $10^{17}$ Ωcm. The critical surface tension of the toner particle after fixing was about 26 dynes/cm.

Comparative Example

The procedures of Example 1 were repeated except that the prepared and used toner particle for forming a reverse image contained 0.3% of the fluorine-containing resin calculated as fluorine and had a volume intrinsic resistivity of $10^{17}$ Ωcm., and the critical surface tension after fixing of 32 dynes/cm. Duplicates having a sharp image were only 150 sheets due to the sedimentation of a toner on the dielectric toner image of the master sheet.

What we claim is:

1. A process of electrostatic printing which comprises the steps of:

(1) forming a reverse image of a dielectric toner on an electroconductive support or a photoconductive support and fixing the reverse image to give an electrostatic printing master sheet, and (2) repeating electrostatic printing procedures of:

(a) electrifying the dielectric toner image of the master sheet, (b) developing the image with a toner, (c) transferring the resultant toner image to a material to be printed and (d) fixing the transferred toner image thereon, said dielectric toner having a volume intrinsic resistivity of not less than $10^{12}$ Ωcm. and showing a critical surface tension of not more than 30 dynes/cm. after fixing, and containing at least 0.5% by weight of a fluorine-containing resin calculated as fluorine, wherein said fluorine-containing resin has a melting point or softening point of not less than 60° C. and a melt viscosity of not less than about $5\times10^4$ poises at a temperature of not more than 180° C., and is a homopolymer of a fluorinated monomer or a copolymer of the fluorinated monomer with a non-fluorinated monomer, the molecular weight of said homopolymer or copolymer being from 10,000 to 500,000, and the fluorinated monomer having the following general formula:

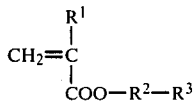

wherein $R^1$ is hydrogen, methyl, ethyl or propyl; $R^2$ is the group $$-(CH_2)_l-$$

wherein l is an integer of 1 to 3, the group

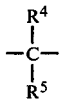

wherein $R^4$ and $R^5$ are independently hydrogen, methyl, ethyl or propyl, provided that $R^4$ and $R^5$ are not simultaneously hydrogen, the group

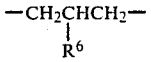

wherein $R^6$ is hydroxyl group or acetoxyl group, or the group

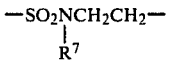

where $R^7$ is methyl, ethyl or propyl; and $R^3$ is the group $$-(CF_2)_mCF_3$$

where m is 0 or an integer of 1 to 18, the group

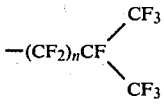

where n is 0 or an integer of 1 to 18, the group $$-(CF_2)_qH$$

where q is an integer of 2 to 6, or the group $-CF_2CFHCF_3$.

* * * * *